United States Patent [19]

Liebhardt et al.

[11] 4,449,454

[45] May 22, 1984

[54] SAFETY MECHANISM FOR AN EXPLOSIVE BODY

[75] Inventors: Josef Liebhardt, Schrobenhausen; Rudolf Fuhrer, Baar; Erich Dautel, Schrobenhausen, all of Fed. Rep. of Germany

[73] Assignee: Messerschmitt-Boelkow-Blohm Gesellschaft mit beschraenkter Haftung, Munich, Fed. Rep. of Germany

[21] Appl. No.: 435,325

[22] Filed: Oct. 19, 1982

[30] Foreign Application Priority Data

Nov. 3, 1981 [DE] Fed. Rep. of Germany ..... 3143514

[51] Int. Cl.[3] ..... F42C 9/06; F42C 15/04; F42C 15/28

[52] U.S. Cl. ..... 102/226; 102/228; 102/229; 102/256; 102/259

[58] Field of Search ..... 102/226, 259, 260, 225, 102/228, 254, 229, 221, 222, 223, 256

[56] References Cited

U.S. PATENT DOCUMENTS

| | | | |
|---|---|---|---|
| 2,958,285 | 11/1960 | Marshall | 102/259 X |
| 2,960,037 | 11/1960 | Raech et al. | 102/259 X |
| 2,981,192 | 4/1961 | Grandy | 102/259 X |
| 3,576,165 | 4/1971 | Gawlick et al. | 102/258 |
| 3,760,734 | 9/1973 | Brothers | 102/259 X |
| 3,961,577 | 6/1976 | O'Steen | 102/258 X |
| 3,968,751 | 7/1976 | Palifka | 102/228 |
| 4,006,689 | 2/1977 | Bastide | 102/226 |

*Primary Examiner*—David H. Brown

*Attorney, Agent, or Firm*—W. G. Fasse; D. H. Kane, Jr.

[57] ABSTRACT

An explosive body such as a rocket, bomb, cluster shell, or the like is provided with a safety mechanism which assures that the explosive body cannot explode in its launching tube nor shortly after leaving the launching tube. The mechanism also makes sure that a body which has been accidentally cocked cannot be inserted into its launching tube. For these purposes the safety mechanism has a slide (3) carrying a detonator and slidable in a housing under the control of a spring loaded see-saw lever (2) having one lever arm (16) cooperating with a plurality of position controllable stops (11, 12, 32) and another lever arm (17) cooperating with stop shoulders (5 or 6) of the slide (3) whereby shifting of the detonator into its arming or "life" position takes place in at least two steps. An arresting device (21) prevents the shifting of the slide back into the safety-on position once the slide has moved to any extent in the arming or safety-off direction.

10 Claims, 1 Drawing Figure

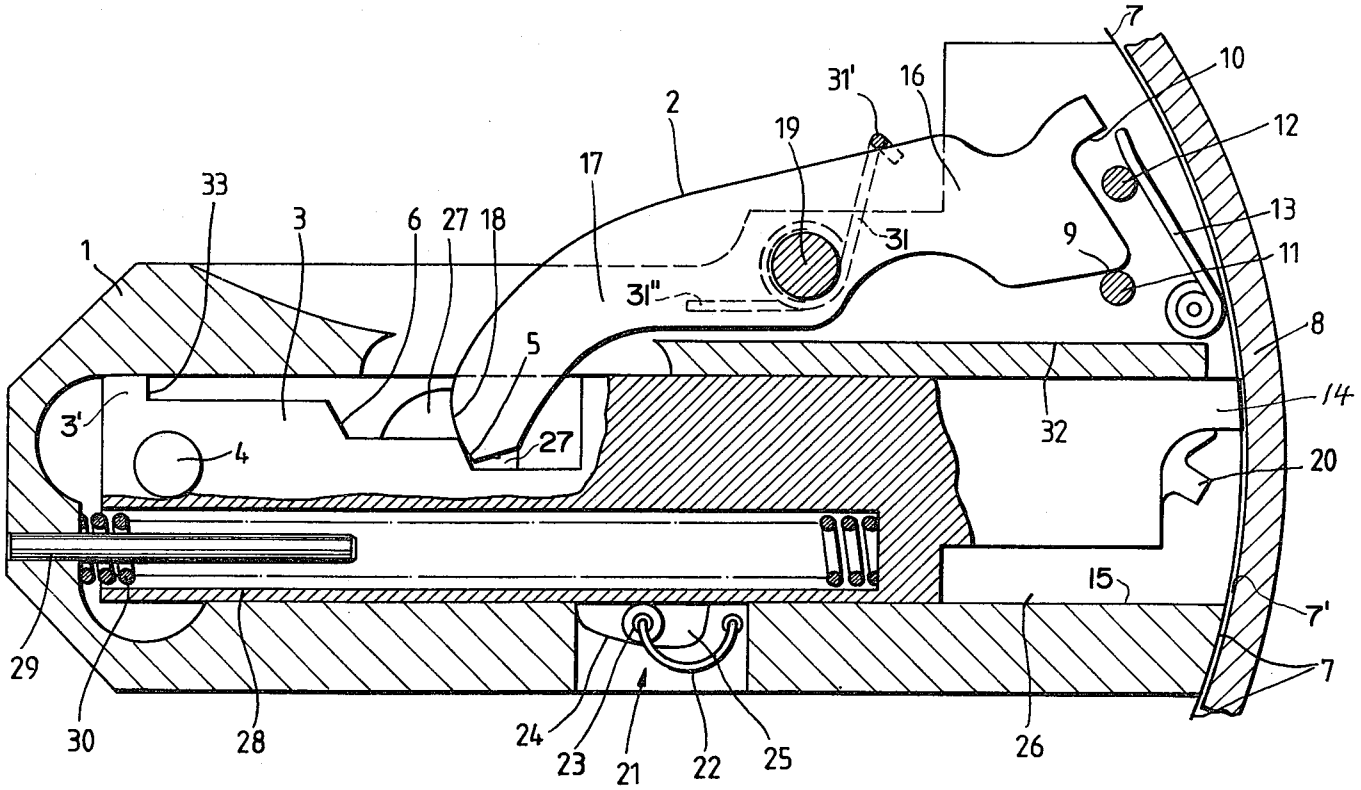
7
10
12
13
11
8
14
20
7'
7
9
32
15
26
16
31'
31
19
2
31''
17
5
27
18
27
6
3
33
1
4
3'
28
30
29
25
22
21
23
24

SAFETY MECHANISM FOR AN EXPLOSIVE BODY

CLAIM TO PRIORITY

The present application is based on German Patent Application No. P 31 43 514.9, filed in the Federal Republic of Germany on Nov. 3, 1981. The priority of the German filing date is claimed for the present application.

BACKGROUND OF THE INVENTION

The present invention relates to a safety mechanism for an explosive body which may be launched from a launching tube. Normally, the explosive body rests with its outer contour in a slidable manner against the inner surface of the launching tube. Such explosive bodies comprise a fuse mechanism including a detonator which may be shifted from a safety-on position into a firing or detonating chain in which the detonator forms a link. As long as the detonator link is missing in the chain, the explosive body cannot explode or be exploded.

Such explosive bodies, for example, in the form of cluster ammunition or shells and bombs are placed in launching tubes or so-called cup dischargers for transporting these explosive bodies to the location where they are intended to explode. Such explosive bodies generally have either a relatively flat shape or they have the shape of a longitudinal cylinder. In both instances the explosive body contacts with its outer contour, such as a cylindrical outer contour the correspondingly shaped inner surface of the launching tube or cup discharger when the explosive body is inside the launching tube or cup discharger, except for a very slight play. Such explosive bodies are equipped with a fuse mechanism which comprises a so-called firing or detonating chain in which a detonator forms a link in a sequence of several series connected firing or detonating elements. In order to provide a safety feature, the detonator forming one of these firing or detonating elements may be moved out of the chain so that the latter is interrupted. In order to provide the safety-off condition of the explosive body, the detonator may be shifted fully into the firing or detonating chain at a desired or suitable point of time.

For safety reasons it is necessary to take care that the explosive body cannot explode inside the launching tube, nor within a certain safety spacing following the launching. It is further required that the final safety-off condition of the fuse mechanism is delayed sufficiently long for this purpose. Further, the required safety features must also be present prior to placing the explosive body into a launching tube or cup discharger. Thus, it is necessary that the explosive body cannot be placed into a launching tube or cup discharger when the fuse mechanism is already fully or even partially in a safety-off position.

OBJECTS OF THE INVENTION

In view of the above it is the aim of the invention to achieve the following objects singly or in combination:

to satisfy the above outlined safety requirements while simultaneously assuring a simple structural arrangement of the components of the safety mechanism;

to assure the functional reliability of the safety mechanism under all operating conditions while nevertheless satisfying the safety requirements;

to provide a safety mechanism for an explosive body which may be controlled by an electrical signal which is generated after the explosive body has reached a sufficient speed for rotating a wind wheel for generating the respective electrical signal; and to construct the safety mechanism so that the movement of a slide will take place in several stages, preferably in at least two stages.

SUMMARY OF THE INVENTION

The above objectives have been achieved according to the invention in a safety mechanism which comprises a rotatably supported spring biassed locking lever which is arrestable in several sequential angular positions. The present mechanism further comprises a slide member which carries the detonator and which is spring loaded in a predetermined longitudinal direction. The slide member is provided with stop shoulders for cooperation with the locking lever in its several angular positions. In a first angular position of the locking lever the slide member is in the safety-on position. The next following or second position constitutes an intermediate position in which the slide member has moved partially toward the safety-off position. In the last or third position the detonator has been moved as a link into the firing or detonating chain representing the safety-off position. In the safety-on position the slide has an end portion located approximately in register with the outer contour of the explosive body. However, in the intermediate position and in the safety-off position the slide projects from the outer contour of the explosive body to such an extent that insertion of the explosive body into a launching tube or into a cup discharger is prevented. Thus, the present safety mechanism comprises several, preferably, two positons for reaching the fully safety-off position.

The stages or positions of the slide member and of the angular positions of the locking lever are correlated relative to one another and determine the several release stages. Simultaneously, there is a coordination between the angular positions of the locking lever and the functional slide positions of the slide member to provide for the full safety-on position and the full safety-off position. The intermediate position provides time for the activation of the energy supply for the detonator, for example, by the generation of an electrical signal by means of a wind driven electrical generator.

The slide member is biassed by a compression spring which tends to move the slide member in the longitudinal direction out of the outer contour of the explosive body. In the safety-on position the biassing of the spring is initially counteracted in that the locking lever in its first angular position engages a respective stop shoulder of the slide member. In this first position the slide member is fully inside with its entire length in the explosive body so that an end portion of the slide member registers, as mentioned, with the outer contour of the explosive body, whereby it is assured that the explosive body can be introduced into a launching tube or cup discharger only when it is in its fully safety-on condition.

Just shortly prior to the launching, the first "safety-on position" is released so that the locking lever under the action of its own biassing spring can move into its second angular position where it is also arrested. However, in the meantime, the slide member is now subject to the biassing force of its biassing compression spring which pushes the slide member just sufficiently in the predetermined direction toward the safety-off position until an end portion of the slide member contacts the inner surface of the launching tube which thus prevents any further outward movement of the slide member. This feature makes sure that the safety-on condition is still assured as long as the explosive body is still within the launching tube. This is so because in this intermediate position the detonator is not yet forming a link in the firing or detonating chain and therefore the detonator cannot yet be activated.

If now the explosive body is launched from a launching tube, the slide member can move outwardly under the force of its biassing spring to such an extent or rather until the locking lever in its second position engages the second stop shoulder of the slide member. Thus, the slide member has reached its intermediate position in which the detonator is still not forming a link in the firing chain so that the safety is still assured for a certain duration following the point of time when the explosive body leaves the launching tube.

The just mentioned intermediate position may be used to activate the energy supply for the firing chain while simultaneously providing a time delay for releasing the locking lever from its second arrested position. At the earliest, the slide member and thus the detonator carried thereby can be moved as a link into the firing chain after said time delay has been completed, thus permitting the slide member to move into the safety-off position. Due to the mentioned time delay it is also assured that the safety conditions prior to placing an explosive body into the launching tube are satisfied. Due to the fact that the slide member projects substantially from the outer contour of the explosive body after the initial safety-on position is released, it is in this intermediate condition or position no longer possible to insert the explosive body into a launching tube or cup discharger. Such insertion is possible only as long as the slide member is in the full safety-on position. This feature also assures the safety required during the placement of an explosive body into the respective launching tube.

BRIEF FIGURE DESCRIPTION

In order that the invention may be clearly understood, it will now be described, by way of example, with reference to the accompanying drawings, wherein the single FIGURE shows a sectional view through a safety mechanism according to the invention, whereby the sectional plane extends substantially perpendicularly to the longitudinal axis of an explosive body.

DETAILED DESCRIPTION OF PREFERRED EXAMPLE EMBODIMENTS AND OF THE BEST MODE OF THE INVENTION

The safety mechanism according to the invention comprises a housing 1 which is insertable into an explosive body 7, whereby the outer contour of the explosive body 7 is slidable within a launching tube 8 due to a small conventionally provided play 7'. The longitudinal axis of the explosive body 7 extends perpendicularly to the sheet of the drawing. The housing 1 is inserted into the explosive body 7 at a right angle to said longitudinal axis. The housing 1 is provided with a longitudinal opening or channel 26 having, for example, a rectangular cross-section. A slide member 3 is inserted for sliding movement into the channel 26 and cooperates in the locking function with a locking lever 2 to be described in more detail below. In the shown safety-on position the right-hand end 14 of the slide member 3 is substantially within the outer contour of the explosive body 7. The slide member 3 carries near its left-hand end 3' a detonator 4. The detonator 4 forms a link within a firing or detonating chain comprising other firing elements not shown. The position of this firing chain is indicated in the drawing by an opening 27 extending with its longitudinal axis perpendicularly to the plane of the drawing. This opening or bore 27 extends through the rear wall of the housing 1. The slide member 3 is provided with a dead end bore 28 in which a compression first biassing spring 30 is inserted. The spring 30 is guided by a guide pin 29 held in the rear end portion of the housing 1. In the shown position of the slide member 3 the compression spring 30 is compressed so that a biassing force is constantly exerted on the slide member 3 in the shown position thereby moving the stop shoulder 5 of the slide member 3 against the contour 18 of the left arm 17 of the locking lever 2. Thus, if the locking lever 2 would be released from its engagement with the stop shoulder 5, the spring 30 would tend to move the right-hand end 14 of the slide member 3 out of the outer contour of the explosive body 7 and thus against the inner surface of the launching tube 8.

The slide member 3 is held in its shown safety-on position by the locking lever 2 which is mounted for a see-saw action on a journal bolt 19 supported in the housing 1. A second torque biassing spring 31 is also mounted on the journal bolt 19 and bears with its upper end 31' against an upper edge of the right-hand arm 16 of the see-saw locking lever 2. The lower end 31" of the torque spring 31 rests against a housing portion not shown. The torque biassing spring 31 tends to rotate the locking lever 2 in the clockwise direction. The left-hand end of the locking lever 2 is provided with a somewhat curved contour 18 for engaging the stopped shoulder 5 of the slide member 3, whereby the latter is prevented from yielding to the urging in the predeterming rightward direction to the force of the compression biassing spring 30. The shown position of the locking lever 2 corresponds to a first angular position in which the locking lever 2 is arrested by a position controllable stop member such as a stop bolt 11 cooperating with a stop surface 9 of the locking lever 2. If the stop bolt 11 is withdrawn from its engagement with the surface 9 of the locking lever 2, the latter rotates clockwise under the influence of the torque biassing spring 31 into a second angular position determined by a second position controllable stop member such as a stop bolt 12. At this point the contour 18 is disengaged from the stop shoulder 5 of the slide 3 whereby the latter could yield to the force exerted by the biassing spring 30 for a rightward movement. However, as long as the explosive body 7 is retained in the launching tube 8 the slide 3 moves by a very small distance to the right until the right-hand end 14 of the slide 3 abuts against the inner surface of the launching tube 8. Such small rightward movement corresponds to the play 7'. This feature of the invention provides the required safety while the explosive body is still in the launching tube.

The release or withdrawal of the stop bolt 11 takes place shortly prior to the launching of the explosive body out of the launching tube 8. A conventional electrical circuit may be used for this purpose forming part of the launching mechanism. The stop bolts 11 and 12 are preferably provided in the form of armature rods forming part of separate electrical release mechanisms not shown since they are conventional. When the stop bolt 11 is withdrawn, the lever 2 moves clockwise so that its stepped stop surface 10 engages the stop bolt 12. The stepped stop surfaces 9 and 10 form part of the right-hand lever arm 16 of the locking lever 2.

If the explosive body now leaves the launching tube 8, the slide 3 moves instantly to the right until the contour 18 engages the stop shoulder 6 of the slide 3 in the second angular position of the locking lever 2. The slide 3 is now held in an intermediate position which does not yet correspond to the safety-off condition because the detonator 4 is not yet placed in register with the bore 27 and thus does not yet form a link in the firing chain. In this intermediate position the slide 3 extends so far outside the outer contour of the explosive body 7 that a wind wheel 20 held at the right-hand end 14 of the slide 3 may start rotating due to its being exposed to the air flow along the explosive body travelling through the air. An electric generator driven by the wind wheel 20 may now activate the energy supply for the firing chain and to also switch on a time delay for delaying the withdrawal of the stop bolt 12. When this time delay ends, the stop bolt 12 will be withdrawn from engagement with the stepped stop surface 10 of the lever 2, whereby the latter will further tilt in the clockwise direction under the torque of the spring 31 until the stop surface 9 engages a housing member 32 or any other suitable stop. Thus, the engagement of the contour 18 with the stop shoulder 6 is released so that the slide 3 can move further to the right into the safety-off position in which the detonator 4 is brought into coaxial register with the bore 27. The slide 3 is maintained in its safety-off position by the engagment of a further stop surface 33 with a further stop member not shown but suitably located in the housing 1. Such further stop member may, for example, extend perpendicularly to the plane of the drawing in the channel 26 of the housing 1. Thus, the firing or detonating mechanism is now ready to receive a firing signal which, depending on the type of the explosive body, may come from a respective sensor not shown since such firing mechanisms are well known in the art.

The orientation of the stop shoulders 5 and 6 of the slide 3 relative to the contour 18 of the locking lever 2 is to be correlated relative to one another in such a manner that all forces introduced by the slide 3 into the locking lever 2 are taken up completely by the journal bolt 19, thereby avoiding exerting any torque moments on the locking lever relative to its journal bolt 19. Thus, the stop bolts 11 and 12 which are dimensioned to have a smaller strength relative to the journal bolt 19 are exposed only to the torque exerted by the torque biassing spring 31 and do not have to take up any other forces. Thus, neither the pressure caused by the compression spring 30 through the slide 3 on the locking lever 2 nor the blow resulting from the impact of the contour 18 on the stop shoulder 6 results in a loading of the stop bolts 11 or 12.

The stop shoulders 5 and 6 preferably have plane surfaces, while the contour 18 of the lever 2 has a small curvature. The locking lever 2 with its two lever arms 16 and 17 is fully balanced to form a see-saw lever. The torque spring 31 must be strong enough to overcome the friction contact forces between the stop shoulders 5 or 6 on the one hand, and the contour 18 of the locking lever 2 when the stop bolts 11 or 12 have been released.

The proper sequence for the releasing of the stop bolts 11 and 12 have been mentioned above. If, for example, the stop bolt 12 should be withdrawn first, the invention provides for a further safety feature in the form of a safety catch spring 13 which moves counterclockwise into engagement with the stepped stop surface 10 as long as the stop surface 9 still engages the stop bolt 11. Thus, the locking lever 2 is permanently arrested and movement of the slide 3 into the full safety-off position is prevented. This further safety feature is particularly of importance where the accidental or erroneous withdrawal of the stop bolt 12 prior to the withdrawal of the stop bolt 11 takes place inside the launching tube 8.

Without this safety feature the slide 3 could move instantly all the way to the right at the moment of leaving the launching tube 8 whereby the requirement of a safety delay following the launching would not be satisfied anymore. However, the safety catch spring 13 satisfies this requirement.

In order to make sure that an explosive body 7 can be inserted into a launching tube 8 only when the slide 3 is in the shown left-hand safety-on position, the invention provides an arresting device 21 which prevents that the slide 3 can be pushed back into the housing 1 after it has moved partially out of the safety-on position. The arresting device 21 comprises a spring 22 having a predetermined shape for holding a clamping roller 23 in the proper position. The clamping roller 23 engages on the one hand the plane lower outer surface of the slide 3 and on the other hand, it is movable up or down on a slanted surface 24 in the housing 1. The slanting surface 24 is located in a recess 25 in the housing 1 and its slope is so directed that the outward movement of the slide 3 toward the right is permitted, but that the leftward back in movement of the slide 3 is prevented. Thus, the arresting device 21 prevents that an explosive body 7 may be inserted into a launching tube 8 after the safety mechanism or rather the stop bolts 11 and 12 thereof have already been withdrawn so that the locking lever 2 cannot provide any locking function for the slide 3 anymore.

Although the invention has been described with reference to specific example embodiments, it will be appreciated, that it is intended to cover all modifications and equivalents within the scope of the appended claims.

We claim:

1. A safety mechanism for an explosive body adapted for expulsion from a launching tube in which the explosive body may rest with its outer contour in sliding contact with the inner surface of a launching tube, comprising a fuse mechanism including a detonator forming a link in a firing chain, housing means (1) insertable into an explosive body, a slide member (3) having a plurality of stop shoulders (5, 6, 33) and carrying said detonator (4) for moving said detonator as a link into said firing chain, said slide member (3) being movably received in said housing means, first spring means (30) in said housing means urging said slide member (3) in a predetermined direction, locking lever means (2), journal means (19) tiltably supporting said locking lever means in said housing means for cooperation with at least two of said locking shoulders of said slide member (3) in a plurality of different slide member positions corresponding to different angular positions of said locking lever means (2), second spring means (31) biasing said locking lever means (2) in said plurality of positions, whereby each of said stop shoulders corresponds to a different angular position, a first of said angular positions defining the safety-on position of the slide member (3), a second of said angular positions defining an intermediate safety position of the slide member (3), a third of said angular positions defining the safety-off position of the slide member (3), whereby said slide member (3) in said first position permits the insertion of an explosive body into a launching tube, but prevents such insertion when the slide member is in its second or third position.

2. The safety mechanism of claim 1, wherein said slide member (3) has a first end (3') carrying said detonator, and a second end (14) which extends out of said housing means (1) when said slide member is in said second position, said mechanism further comprising a generator wind wheel (20) operatively carried at said second slide end (14) for generating an electrical signal when said explosive body is passing through air and said slide member is in said second position.

3. The safety mechanism of claim 1, further comprising an arresting device (21) operatively arranged in said housing means for cooperation with said slide member to permit movement of said slide member in said predetermined direction, and to prevent movement of said slide member in the opposite direction.

4. The safety mechanism of claim 3, wherein said arresting device comprises an arresting roller (23), a recess (25) in said housing means, a slanted surface (24) in said recess, biasing spring means (22) holding said arresting roller (23) in contact with said slanted surface (34) and with said slide member (3), said slanted surface being so inclined that movement of the slide member in the predetermined direction is permitted and movement of the slide member in the opposite direction is arrested.

5. The safety mechanism of claim 1, wherein said locking lever means comprise stepped stop surfaces, said mechanism further comprising withdrawable stop members (11, 12,) reaching into said housing means for cooperation with said stepped stop surfaces of said locking lever means (2), said stop members corresponding in their positions to said angular positions of said locking lever means (2).

6. The safety mechanism of claim 5, wherein said stop members (11, 12) comprise electrically operable armature rods.

7. The safety mechanism of claim 5, wherein said stop members comprise first and second withdrawable stop bolts (11, 12), said second stop bolt (12) cooperating with said locking lever means in said second, intermediate position of the locking lever means, said mechanism further comprising spring means (13) arranged for cooperation with said second withdrawable stop bolt (12) so that said stop bolt (12) normally holds said spring means (13) in a position for preventing the effect of an accidental, unintended withdrawal of the stop bolt (12) prior to withdrawal of the first stop bolt (11), whereby said spring means (13) keeps holding said locking lever means (2) in said second intermediate position, while intended withdrawal of said second stop bolt (12) after the withdrawal of the first stop bolt (11) will prevent said spring means (13) from engaging said locking lever means (2).

8. The safety mechanism of claim 7, wherein said two stop bolts (11, 12) comprise an electrically operable armature rods.

9. The safety mechanism of claim 5, wherein said locking lever means comprise a see-saw lever (2) supported by said journal means (19), said see-saw lever (2) having a first lever arm (16) carrying said stepped stop surfaces (9, 10) arranged for cooperation with said stop members (11, 12), said see-saw lever having a second lever arm (17) with a contour (18) for cooperation with said stop shoulders (5 or 6 ) of said slide member (3).

10. The safety mechanism of claim 9, wherein said second lever arm (17) with its contour (18) is so located and oriented relative to the stop shoulders (5 and 6 ) of the slide member (3) that any forces exerted by said first spring means (30) on said slide member (3) are taken up by said journal means (19) without causing a torque moment on said locking lever means (2) relative to said journal means.

* * * * *